US007677870B1

(12) United States Patent
Matheny

(10) Patent No.: US 7,677,870 B1
(45) Date of Patent: Mar. 16, 2010

(54) SCREW IN BLADE/VANE

(75) Inventor: Alfred P. Matheny, Jupiter, FL (US)

(73) Assignee: Florida Turbine Techologies, Inc., Jupiter, FL (US)

( * ) Notice: Subject to any disclaimer, the term of this patent is extended or adjusted under 35 U.S.C. 154(b) by 338 days.

(21) Appl. No.: 11/409,926

(22) Filed: Apr. 22, 2006

Related U.S. Application Data

(60) Provisional application No. 60/718,264, filed on Sep. 16, 2005.

(51) Int. Cl.
*F01D 5/32* (2006.01)

(52) U.S. Cl. ..... 416/206; 416/61; 416/221; 415/118; 415/201

(58) Field of Classification Search ..... 415/118, 415/201; 416/61, 204 R, 204 A, 205–207, 416/209, 219 R, 220 R, 221; 411/411, 423
See application file for complete search history.

(56) References Cited

U.S. PATENT DOCUMENTS

| | | | | | |
|---|---|---|---|---|---|
| 138,277 | A | * | 4/1873 | Peet | 411/436 |
| 705,866 | A | * | 7/1902 | Punzelt | 416/207 |
| 1,844,382 | A | * | 2/1932 | Dardelet | 411/416 |
| 1,878,816 | A | | 9/1932 | Bucklen | |
| 2,038,670 | A | | 4/1936 | Noack | |
| 2,115,454 | A | | 4/1938 | Berliner | |
| 2,708,564 | A | | 5/1955 | Erickson | |
| 2,718,268 | A | * | 9/1955 | Cushman | 416/205 |
| 2,909,380 | A | * | 10/1959 | Hoye et al. | 285/333 |
| 3,066,850 | A | * | 12/1962 | Coron et al. | 415/201 |
| 3,077,228 | A | * | 2/1963 | Mohn | 416/207 |
| 3,219,314 | A | * | 11/1965 | Petrie | 416/97 R |
| 3,565,547 | A | | 2/1971 | Hansen | |
| 3,799,698 | A | | 3/1974 | Haworth | |
| 3,985,465 | A | * | 10/1976 | Sheldon et al. | 415/201 |
| 4,004,832 | A | * | 1/1977 | Connelly | 285/333 |
| 4,820,127 | A | * | 4/1989 | Cohen et al. | 416/221 |
| 5,462,411 | A | | 10/1995 | Bianchi | |
| 5,788,441 | A | * | 8/1998 | Karabestos et al. | 411/366.3 |
| 6,692,233 | B2 | * | 2/2004 | Liang | 416/221 |
| 7,431,565 | B2 | * | 10/2008 | Hernandez et al. | 416/219 R |

FOREIGN PATENT DOCUMENTS

| | | | | | |
|---|---|---|---|---|---|
| GB | 2104997 | A | * | 3/1983 | |
| JP | 64-69702 | A | * | 3/1989 | 416/221 |
| SU | 1714170 | A1 | * | 2/1992 | 416/221 |

* cited by examiner

*Primary Examiner*—Christopher Verdier
(74) *Attorney, Agent, or Firm*—John Ryznic

(57) ABSTRACT

A turbo machine airfoil, such as a blade or a vane in a compressor, in which the airfoil root portion includes screw threads having a dove tail cross sectional shape, and the rotor disk includes holes having similar screw threads such that a blade or vane can be easily replaced by unscrewing the old blade or vane and screwing in a new blade or vane. A locking pin biased by a spring is located in the root of the airfoil to lock the airfoil in the threaded hole to prevent the airfoil from loosening due to vibrations and to lock the airfoil in place at a desired angle of attack for maximum efficiency of the turbo machine. The removable cover plate is located on the casing and over the rotor disk such that the blade can be removed through the opening without the need to disassemble the turbo machine.

8 Claims, 5 Drawing Sheets

SCREW IN BLADE/VANE

CROSS-REFERENCE TO RELATED APPLICATIONS

This application claims the benefit to an earlier filed Provisional Application No. 60/718,264 filed on Sep. 16, 2005 and entitled SCREW IN BLADE/VANE.

STATEMENT REGARDING FEDERALLY SPONSORED RESEARCH OR DEVELOPMENT

None.

BACKGROUND OF THE INVENTION

1. Field of the Invention

The present invention relates to turbomachinery, and more particularly to a turbine airfoil with structure to secure the airfoil to a rotor disc.

2. Description of the Related Art Including Information Disclosed Under 37 CFR 1.97 and 1.98

In a turbo machine such as an axial flow compressor or an axial flow turbine, it is sometimes necessary to remove and replace a damaged blade or vane. Prior art turbo machines make use of a dovetail slot in the rotor disk in which a similar shaped dovetail root of an airfoil slides within to secure the airfoil to the rotor disk against radial movement. To remove an airfoil from this type of rotor requires significant disassembly of the turbo machine in order to remove the airfoil from the slot. The casing must be removed, and one or more vanes must be removed in order to make space for the blade to be able to slide out from the slot for removal.

One way of solving this problem is disclosed in the U.S. Pat. No. 3,565,547 issued to Hansen on Feb. 23, 1971 which shows a turbo machine rotor construction in which a blade includes a root portion having an externally threaded shank portion, and the rotor disc includes radially extending tapped opening with screw threads such that the blade can be screwed out of the opening and another blade easily installed. In a blade attached to the rotor disk like the Hansen invention, the blade can be easily removed from the rotor disk by unscrewing the blade. One of the problems with the Hansen invention is the use of regular type screw threads typically found on bolts. Most of the shear stress in the threads of the Hansen invention is located at the top two threads. In a turbo machine such as an axial flow compressor, the most efficient performance is established when the $AN^2$ is at a maximum value. With the screw type threads of the Hansen invention, the high rotation speeds required to reach a high performance level would result in stress levels on the threads large enough to cause damage to the threads and result in the blade pulling out from the rotor disk.

Another problem with the Hansen invention is that the blade must be rotated and tightened in the opening to prevent the blade from loosening due to vibrations. The airfoils on the blade must be precisely set such that the angle of attack of the airfoil is positioned properly, especially if a guide vane is used upstream of the blade or if several rows of blades and vanes are used. Due to tolerances in the threads on both the blade root and the opening in the rotor disk, the angle of attack on the airfoil may not be properly aligned when the blade is tightly screwed into the opening.

What is needed in the art of turbo machinery is a threaded connection between the blade (airfoil) and the rotor disk that would allow for the blade to be removed without breaking down the casing, but would also allow for high rotation speeds such that the $AN^2$ is at a maximum value.

It is therefore an object of the present invention to provide for a turbo machine having radially extending airfoils in which the airfoil can be easily removed without disassembling the casing or other turbo machine parts.

It is another object of the present invention to provide for a screw type connection between the airfoil root and an opening in the rotor disk that will allow for high rotation speeds without causing high stress levels in the screw type connection.

It is another object of the present invention to provide for a screw type connection between an airfoil and a rotor disk that includes a locking member to prevent the threaded members from loosening due to vibrations in the rotor disk, and to set the airfoil at the proper angle of attack for maximum performance.

It is another object of the present invention to provide for an opening in the casing of the turbo machine such that the airfoil can be easily removed from the rotor disk through the opening without having to disassemble the turbo machine.

It is another object of the present invention to allow for a turbomachinery that uses less material and therefore is lighter in weight that other turbo machines.

BRIEF SUMMARY OF THE INVENTION

The present invention is a turbo machine that includes a plurality of blades connected to a rotor disk, where the root of the blade includes screw type threads in the shape of a spiral dove tail in both the blade root and the rotor disk opening such that the blade can be screwed into the opening in a radial direction. The turbo machine casing includes a covered opening located above the rotor disk such that the cover can be easily removed to expose the rotor disk to the opening, and the blade can be easily unscrewed and removed from the rotor disk through the opening.

A spring biased locking pin is also included in the spiral dovetail type connection in order to lock the blade in the rotor disk and to properly set the angle of attack of the blade in the proper position. An outer casing includes individual bosses having the screw threads therein for screwing a vane into the boss, the bosses providing for a lighter casing assembly.

DETAILED DESCRIPTION OF THE INVENTION

Figure 1:
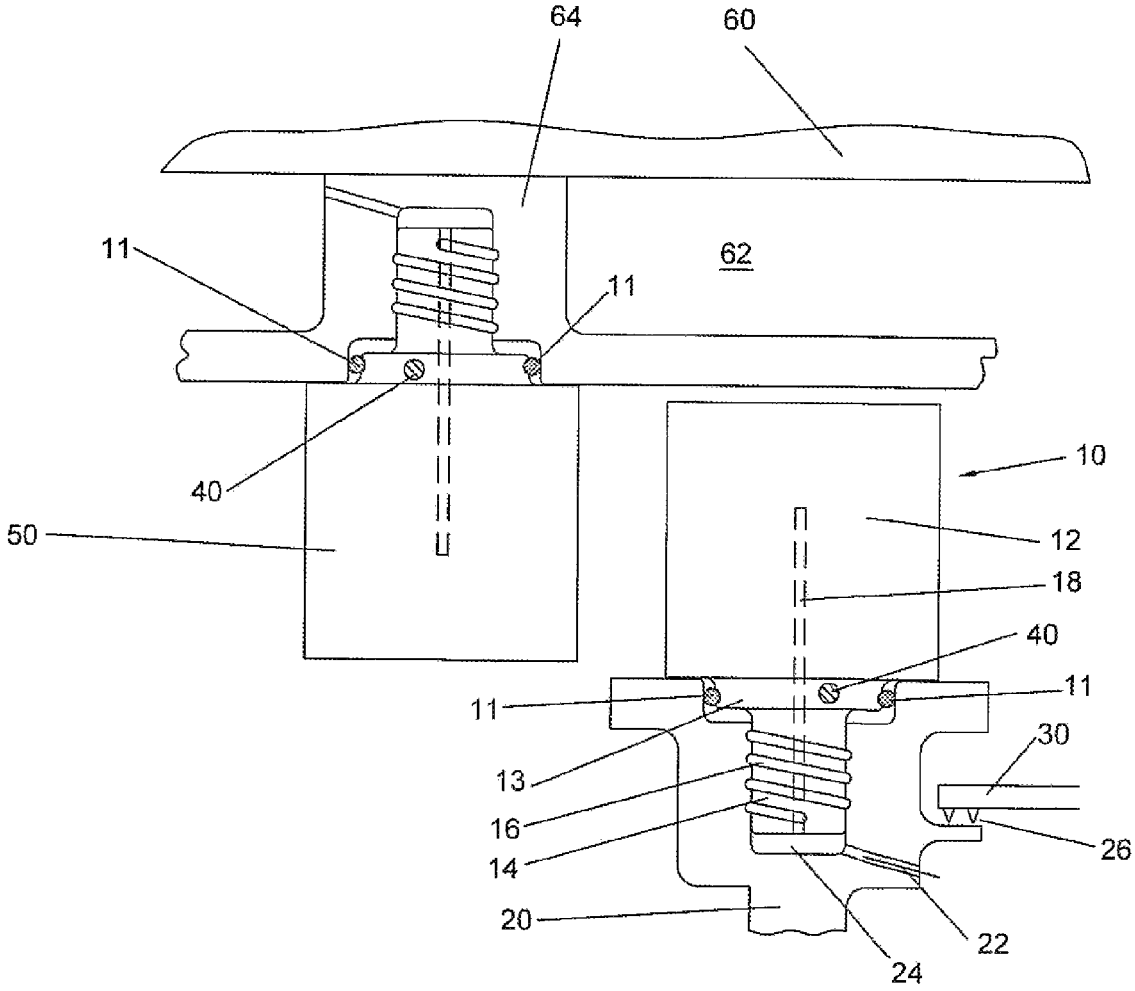
FIG. 1 shows a cross section view of a blade and a vane of the present invention screwed into a threaded recess in a rotor disc and the turbo machine casing.

The present invention is shown in FIG. 1, in which a blade 10 of a turbo machine includes an airfoil portion 12, a root 14 with screw threads 16 formed thereon, a root transition piece 13 having a circular shape and connecting the root 14 to the airfoil portion 12, and a rotor disc 20 in which the blade 12 is secured. The threads 16 are referred to as screw threads, but not with the intention of being equal to the screw threads on a nut as described above. The screw threads 16 of the present invention have a cross sectional shape like that of the dove tail slot used to secure the blade of the prior art to the rotor disk. A cooling air passage 18 passes through the blade 12 for channeling cooling air through the blade. Cooling holes opening onto the airfoil surface can be used to discharge the cooling air onto the airfoil surface for cooling the blade. The rotor disc 20 includes a threaded hole 24 in which the root 14 of the blade 12 is screwed into. The rotor disc 20 includes a cooling air passage 22 to deliver cooling air to the blade cooling air passage 18. A seal member 11 seals a space between the blade transition piece 13 and the recess in the rotor disc 20. A spring biased locking pin 40 slides within a slot formed in both the blade transition piece 13 and the rotor disc recess to prevent rotation of the blade. A seal 26 is formed between an axial extending portion of the blade and a stationary part 30 of the turbo machine. A vane 50 is also shown in FIG. 1 in which the vane 50 also includes a root portion with the screw threads of the present invention. The outer shroud includes a boss 64 having a hole with screw threads therein for securing the vane 50 to the hole as in the blade example described above. Cooling air passages are also present in the vane as in the blade 10. The screw threads of the vane 50 are the same as the screw threads for the blade 10. Seals are also used on the vane 50 as in the blade 10.

Figure 2:
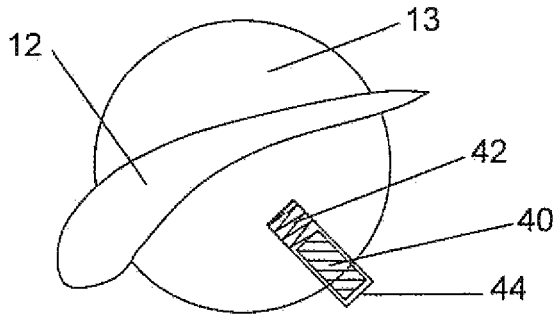
FIG. 2 shows a tip view of a blade of the present invention with the locking pin in place to prevent rotation of the screw portion of the blade root.
Figure 3:
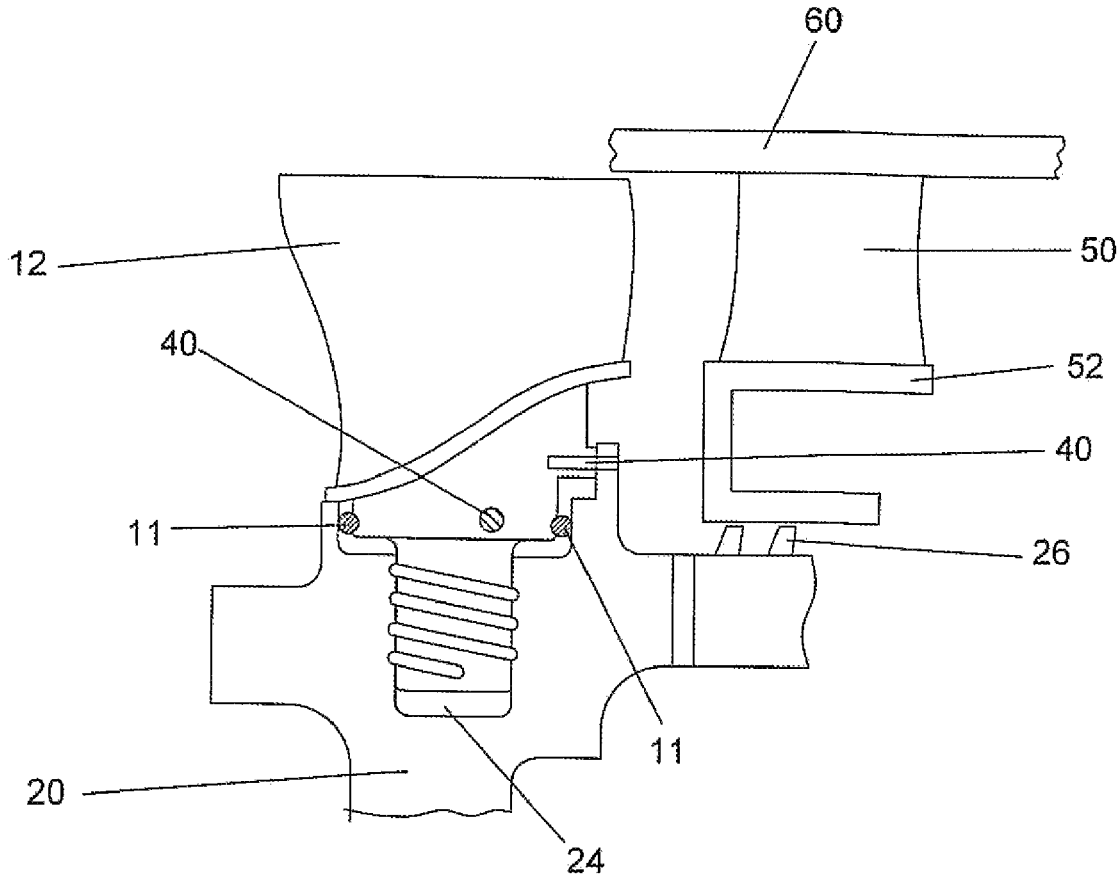
FIG. 3 shows a cross section of the present invention in which the screwed in blade is used in a compressor type turbo machine.
Figure 6:
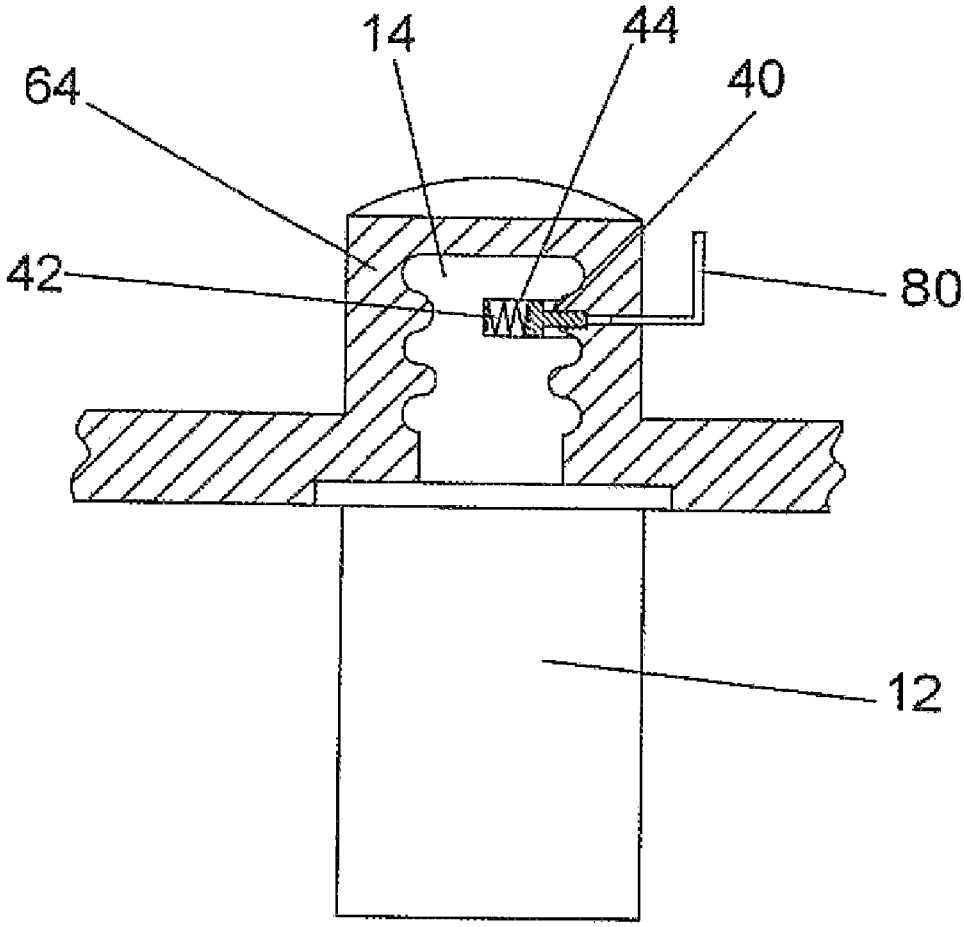
FIG. 6 shows a cross section view of a detailed portion of the spring biased locking pin and an angled tool used to push the pin out of the locking position used in the present invention.

FIG. 2 shows details of the locking pin 40 which fits within a slot 44 formed in both the recess of the rotor and the transition piece of the blade. The locking pin 40 is biased outward by a spring 42. A seal 26 is positioned between a static portion 30 of the turbo machine and the rotor disc 20. The locking pin 40 can be located in the root portion 14 of the airfoil as shown in FIG. 6, or in the root transition piece 13 as shown in FIG. 3. For purposes of the claims, the locking pin is considered to be located in the root portion of the airfoil which is defined to be either the root portion 14 or the root transition piece 13. In the embodiments shown in the Figures, the locking pin is shown to extend outward from the root portion of the airfoil and into a hole formed in the boss member 64 or rotor disk 20. However, a locking pin can be inserted from the boss member 64 or rotor disk 20 and into a hole formed in the root portion 14 of the airfoil. A screw member an be used to extend into a hole formed in the root 20 or boss 64. In this situation, an operator would have to observe when the two holes are aligned before screwing the locking pin into the hole in the root 20 or boss 64. With the spring biased locking pin of the kind extending outward from the root, the operator has only to screw the airfoil into the threaded hole until the locking pin comes into position such that the spring will force the pin into the hole to lock the airfoil in position. No observation as described above is required.

In operation, a blade is secured into the rotor disc by manually pushing the locking pin 40 into the slot 44 against the bias of the spring 42, and the blade root 14 is screwed into the threaded hole 24 of the rotor disc 20. The spring 42 will continue to force the pin 40 outward until the pin 40 is aligned with the slot 44 in the rotor disc 20. The holes in both the transition piece 13 and the rotor disc are aligned at a point in which the blade will be properly position in the rotor disc hole 24. At this position, the spring 42 will move the locking pin 40 into the slot of the rotor disc 20 to lock the blade 10 within the rotor disc hole 24.

FIG. 3 shows the screw threads of the present invention used on a blade of a compressor. A compressor blade 12 is secured to the rotor disk 20 via dove tail shaped screw threads formed in a hole 24 of the rotor disk and on the root portion of the compressor blade 12. A locking pin 40 biased by a spring is used to lock the blade in the proper orientation such that the angle of attack of the blade is maximized. A vane 50 located downstream from the compressor blade 12 extends from an outer shroud 60 of the compressor, and includes an inner shroud 52 that forms a seal 26 with an axial extending portion of the rotor disk 20. In the compressor blade of the FIG. 3 embodiment, no cooling passages are required in the blade 12.

Figure 4:
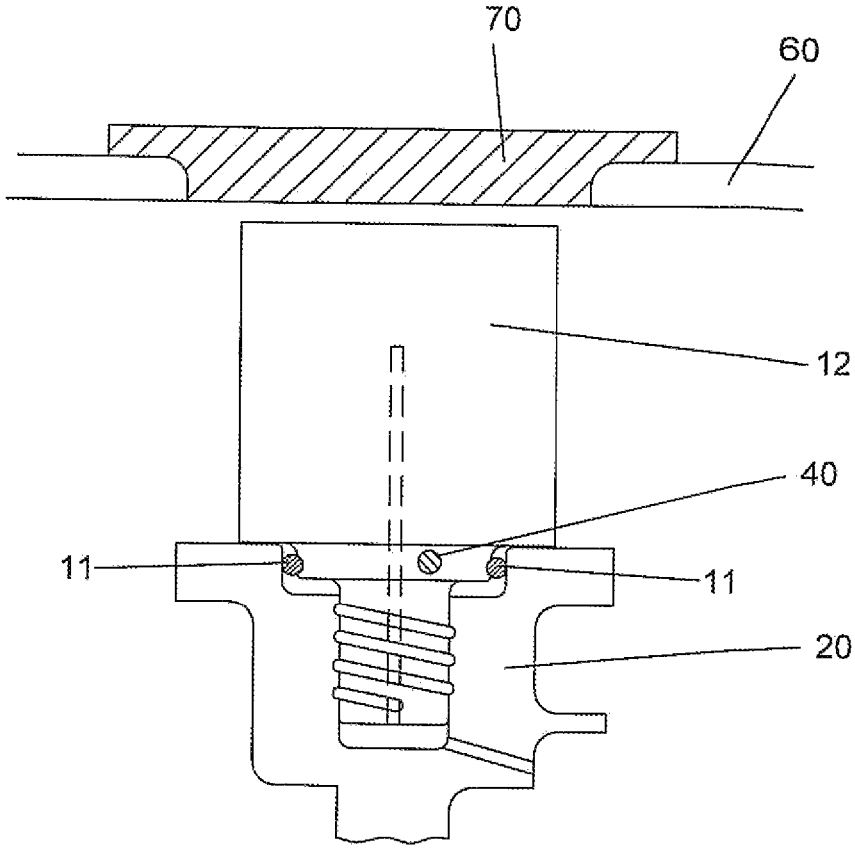
FIG. 4 shows a cross section view of a blade having the screw type connection with an opening in the casing covered by a cover plate.

FIG. 4 shows a removable cover plate 70 to close an opening in the outer shroud or casing 60 of the turbo machine. The cover plate 70 is located over the rotor disk on which the blade is positioned. With the cover plate 70 removed, any blade can be rotated into position and removed through the opening in the casing. A replacement blade can then be reinserted into the threaded hole without having to disassembly other parts of the turbo machine. The cover plate 70 can be any shape such as round, oval, or rectangular as long as the opening that the cover plate 70 covers will allow for the removal of the blade or vane.

Figure 5:
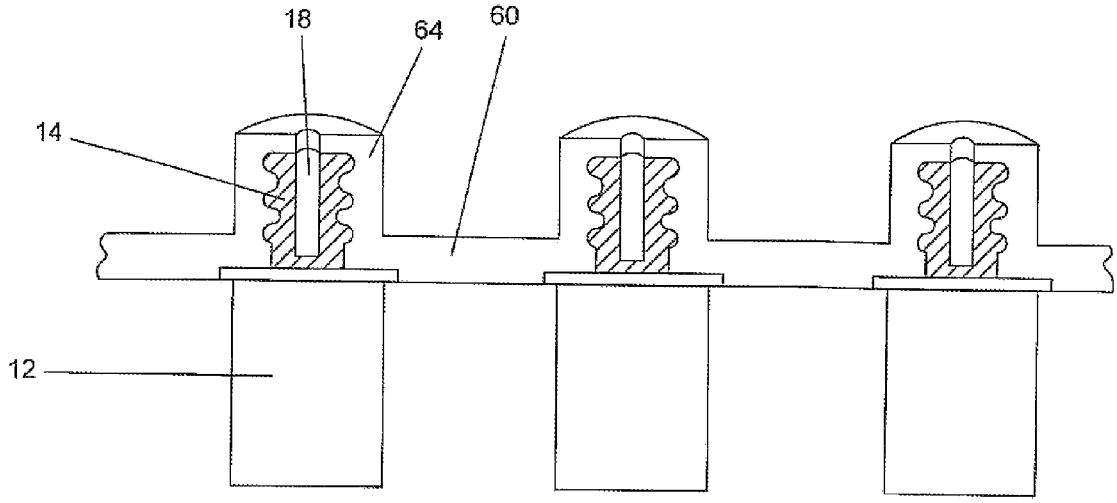
FIG. 5 shows a cross section view of a series of vanes secured to a casing by the screw type connection of the present invention in which each vane is connected to a respective local boss in the casing.

FIG. 5 shows an embodiment of the present invention in which the outer shroud or casing member 60 in which the hole having the screw threads therein are formed as local bosses 64 in order to reduce the weight of the turbo machine. Instead of the outer shroud or casing 60 be of a relatively constant thickness of prior art devices, the screw threads are located in individual bosses 64 spaced around the outer casing 60 such that the thickness of the outer shroud 60 between the bosses 64 can be reduced and therefore provide for a lighter outer casing. The shroud 60 material must be thicker in the region where the screw threads are located in order to provide the minimum number of threads needed to secure the airfoil without exceeded maximum allowable stress levels. This minimum material thickness is not needed in areas outside of the screw threads. Therefore, the bosses allow for the screw threads to be located in thicker portions of the shroud while allowing for thinner portions of the shroud between bosses to reduce the material in the shroud and provide for a lighter turbo machine. The bosses 64 and the root portion 14 of the blade also have a hole 18 in order to reduce the material required and provide for a lighter airfoil 12.

FIG. 6 shows a detailed view of the spring biased pin 40 used to secure the blade 12 to the boss 64. The root 14 of the airfoil 12 includes an opening 44 in which a spring 42 biases the pin 40 outward. The pin 40 in this embodiment includes a large head portion on which the spring provides the bias force, and a thinner main portion that extends out of the hole 44 and into a second hole formed in the boss 20. The second hole opens onto the outer surface of the boss 20 such that a tool 80 can be inserted into the second hole and push the pin 40 against the bias of the spring 42 such that the pin 40 will be displaced out of the second hole and the airfoil 12 can be rotated within the threaded hole of the boss 20. The locking pin 40 can be located in the threaded portion of the root as shown in FIG. 6, or the locking pin can be located in the root transition portion 13 of the airfoil as shown in FIG. 3. The holes in the root portion of the airfoil and in the boss of the shroud must be at such a location that the airfoil will be threaded into the hole to form a tight fit. The locking, pin is also located at a point such that the airfoil angle of attack is at the proper design point to provide for maximum efficiency of the turbo machine.

I claim the following:

1. An airfoil for use in a turbo machine, the airfoil comprising:

an airfoil portion having a leading edge and a trailing edge, and a pressure side and a suction side extending from the leading edge to the trailing edge;

a root portion extending from the airfoil portion, the root portion functioning to secure the airfoil to the turbo machine;

screw threads on the outer surface of the root portion to allow for the airfoil to be screwed into the turbo machine;

the airfoil being threaded into a hole such that each airfoil can be removed from the turbo machine individually;

the screw threads having a dove tail shape cross section;

a locking pin to prevent rotation of the root portion with respect to the hole in which the root portion is screwed into; and, the locking pin is biased outward from the airfoil by a spring.

2. The airfoil of claim 1, and further comprising:

the airfoil includes a platform portion formed between the airfoil portion and the root portion, the platform portion functioning as a fluid flow surface.

3. The airfoil of claim 1, and further comprising:

a cooling fluid passage extending from the root and into the airfoil portion to channel a cooling fluid from external to the airfoil.

4. The airfoil of claim 1, and further comprising:

the airfoil is a rotor blade or a stator vane for the turbo machine.

5. A turbo machine comprising:

a rotor disk having a plurality of holes opening onto an outer surface of the rotor disk, the holes arranged along an annular array;

each of the holes in the rotor disk having a screw thread to receive a thread root portion of a rotor blade;

a rotor blade with a root portion and an airfoil portion extending from the root portion, the root portion having screw threads on an external surface of the root portion to allow for the rotor blade to be screwed into the holes of the rotor disc;

the holes in the rotor disk being spaced to allow for each rotor blade to be removed from the rotor disk without removing any of the other rotor blades screwed into the rotor disk;

the screw threads on the blade roots and on the rotor disk holes have a dove tail shape cross section;

a locking pin for each rotor blade to prevent rotation of the root portion with respect to the hole in the rotor disk;

the locking pin slides within a locking pin hole formed within the root of the blade;

the locking pin is biased outward from the root by a spring; and, the locking pin engages with a second hole formed within the rotor disk when the airfoil is screwed far enough into the threaded hole.

6. The turbo machine of claim 5, and further comprising:

a small hole opening onto a surface of the rotor disk to allow for a tool to be inserted to unlock the pin for each of the rotor blades in the rotor disk.

7. The turbo machine of claim 5, and further comprising:

the rotor disk includes an outer surface that forms an abutment surface for each airfoil when each airfoil is screwed into the hole of the rotor disk at a desired depth.

8. A turbo machine comprising:

a rotor disk having a plurality of holes opening onto an outer surface of the rotor disk, the holes arranged along an annular array;

each of the holes in the rotor disk having a screw thread to receive a thread root portion of a rotor blade;

a rotor blade with a root portion and an airfoil portion extending from the root portion, the root portion having screw threads on an external surface of the root portion to allow for the rotor blade to be screwed into the holes of the rotor disc;

the holes in the rotor disk being spaced to allow for each rotor blade to be removed from the rotor disk without removing any of the other rotor blades screwed into the rotor disk;

the screw threads on the blade roots and on the rotor disk holes have a dove tail shape cross section;

a locking pin for each rotor blade to prevent rotation of the root portion with respect to the hole in the rotor disk;

the threaded holes in the rotor disk each open into a wider hole of the rotor disk, the wider holes opening onto the outer surface of the rotor disk;

each rotor blade includes a root transition portion formed between the airfoil portion and the root portion;

a seal positioned between the outer surface of the root transition portion and an inner surface of the wider hole to form a seal between these two surfaces;

the locking pin is slidably received within a locking pin hole formed within the transition portion, the locking pin biased by a spring in an outward direction; and, a locking pin receiving hole formed within the rotor disk and aligned with the locking pin when the rotor blade is screwed into the rotor disk hole at a desired depth.

* * * * *